US005596937A

United States Patent [19]

McKown

[11] Patent Number: 5,596,937

[45] Date of Patent: Jan. 28, 1997

[54] DELAYED MOTION DRIVE FOR MODEL RAILROAD LOCOMOTIVES

[76] Inventor: William J. McKown, 2527 Mary St., Montrose, Calif. 91020

[21] Appl. No.: 300,153

[22] Filed: Sep. 1, 1994

[51] Int. Cl.[6] ..... B61C 9/00

[52] U.S. Cl. ..... 105/96; 105/26.05; 105/99; 74/415; 464/160

[58] Field of Search ..... 105/26.05, 49, 105/96, 99, 100, 108, 119, 132; 74/406, 411, 415, 435; 464/160

[56] References Cited

U.S. PATENT DOCUMENTS

| | | | |
|---|---|---|---|
| 465,869 | 12/1891 | Maclean | 464/160 |
| 2,640,338 | 6/1953 | Charvat | 464/160 |
| 2,920,502 | 1/1960 | Bungart | 74/395 |
| 4,274,337 | 6/1981 | Shaw | 105/99 |
| 4,540,380 | 9/1985 | Kennedy et al. | 105/119 |
| 4,889,002 | 12/1989 | Abraham | 464/160 |

FOREIGN PATENT DOCUMENTS

| | | | |
|---|---|---|---|
| 1156880 | 5/1958 | France | 74/415 |
| 1255989 | 2/1961 | France | 464/160 |
| 1074765 | 7/1967 | United Kingdom | 74/415 |

*Primary Examiner*—Robert J. Oberleitner
*Assistant Examiner*—S. Joseph Morano
*Attorney, Agent, or Firm*—Daniel C. McKown

[57] ABSTRACT

It is frequently observed that when a real locomotive starts up, the front set of drive wheels commences to turn before the rear set of drive wheels begins to turn. The present invention is a simple device that permits this effect to be simulated in a model locomotive. The electric motor of the model locomotive drives a worm which turns a first gear. A second gear is mounted on the same shaft as the first gear but is not otherwise connected to the first gear. From the side of the first gear that faces the second gear, a pin extends at a particular radius. Similarly, two pins extend at the particular radius from the side of the second gear that faces the first gear. When the motor starts, the first gear turns immediately, but rotation of the second gear is delayed until the pin on the first gear strikes one of the pins on the second gear. In this way a delayed rotary motion is imparted to the second gear.

1 Claim, 2 Drawing Sheets

DELAYED MOTION DRIVE FOR MODEL RAILROAD LOCOMOTIVES

BACKGROUND OF THE INVENTION

1. Field of the Invention

The present invention is in the field of gear drives, and specifically refers to a gear drive system for producing a rotary motion having a selectable amount of initial delay.

2. The Prior Art

The real articulated steam locomotives were characterized by having two complete drive systems. Each drive system was powered by steam in separate sets of expansion cylinders and capable of operating independently of each other.

It is frequently observed that when a real locomotive starts up, the front set of drive wheels commence to turn before the rear set of drive wheels begin to turn. The purpose of the present invention is to simulate in a model locomotive the action of the drive wheels of a real articulated steam locomotive as it starts up under load from a stop.

In a typical model locomotive, the shaft of an electric motor is directly coupled to a first worm gear that turns a helical gear that is coupled through one or more intermediate gears to a rear drive wheel. A forward extension of the motor shaft turns a second worm gear that drives a helical gear that is directly coupled to the forward drive wheels of the locomotive.

FIGS. 1, 2 and 3 show the drive system used by the present inventor in an earlier effort to produce the desired effect. In that earlier embodiment as shown in FIG. 1, the shaft 12 of an electric motor 14 was directly connected to a 11 worm gear 16 that turned the rear drive wheel 18 through intermediate gears 20 and 22. An extension 24 of the motor shaft was connected through a pair of universal joints 26 and 28 to a second worm gear 30 that was used to turn the forward drive wheel 32.

As best seen in FIGS. 2 and 3, the delayed motion of the rear drive wheel 18 was achieved by providing a pin 34 that extended perpendicular to the face of the first intermediate gear 20 and into a slot 36 in the second intermediate gear 22. The first intermediate gear 20 and the second intermediate gear 22 are mounted on a common shaft 38 but can turn independently of the shaft and are coupled to each other only by the pin 34 as it engages the extremities of the slot 36. The second intermediate gear 22 is always engaged to the drive gear 18, which is directly connected to the rear drive wheel.

This technique of using a pin in a curved slot is shown in FIGS. 3 and 4 of U.S. Pat. No. 4,889,002 of Abraham, who uses the mechanism in a linear actuator.

Although this original approach succeeded in producing the desired delayed motion effect, it was subject to two undesirable limitations. First, if the desired delayed motion were relatively long, the curved slot would have to extend a significant part of the way around the gear, thereby weakening the gear. In addition, such a slot had to be milled into the material of the gear, and this operation required specialized equipment. The second difficulty with the use of the curved slot to produce delayed motion was that the amount of delay was fixed by the length of the curved slot and could not be readily altered.

Pin and slot arrangements were also found in U.S. Pat. No. 2,640,338 of Charvat and in U.S. Pat. No. 2,920,502 of Bungart.

In U.S. Pat. No. 4,274,337, Shaw shows the use of a differential gear mechanism to permit slippage of one set of driving wheels with respect to the other in a model locomotive. The approach used in this patent seems unnecessarily complicated and would permit uncontrollable drive wheel slipping in the drive unit with the least amount of friction against the rails. This action reduces the ability of the model to pull a load. The present inventor set out to find a simpler way of achieving the desired effect.

SUMMARY OF THE INVENTION

After trying a number of alternatives, the present inventor at last discovered a design that achieved the desired delayed motion effect and at the same time overcame the limitations of earlier designs.

In accordance with the preferred embodiment, a single pin extends perpendicular to the face of one of the intermediate gears, but that pin is too short to extend to the opposing face of the other intermediate gear. Two pins extend perpendicular to the face of the other intermediate gear, but they also are too short to extend to the face of the first gear. However, all of the pins are at the same radius from the common axles of the gears, and no motion of the second gear takes place until the pin of the first gear has rotated sufficiently to make contact with one of the pins extending from the second gear.

Unlike the pin and slot mechanism discussed above, this mechanism is easy to machine because instead of requiring the machining of an extended curved slot, it requires only the drilling of a hole and the inserting a pin into the hole.

Another advantage over the pin-and-slot technique is that delayed motion approaching a full 360 degrees can be achieved without weakening the gears.

A third advantage of the technique of the present invention is that a number of holes can be provided on the second gear so that the amount of the delayed motion can be selected simply by moving one of the pins from one hole to another hole.

A fourth advantage is that there is no uncontrollable drive wheel slipping once the locomotive is moving, and therefore no loss of traction by either drive unit.

The novel features which are believed to be characteristic of the invention, both as to its structure and its method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figures 4, 5, 6:
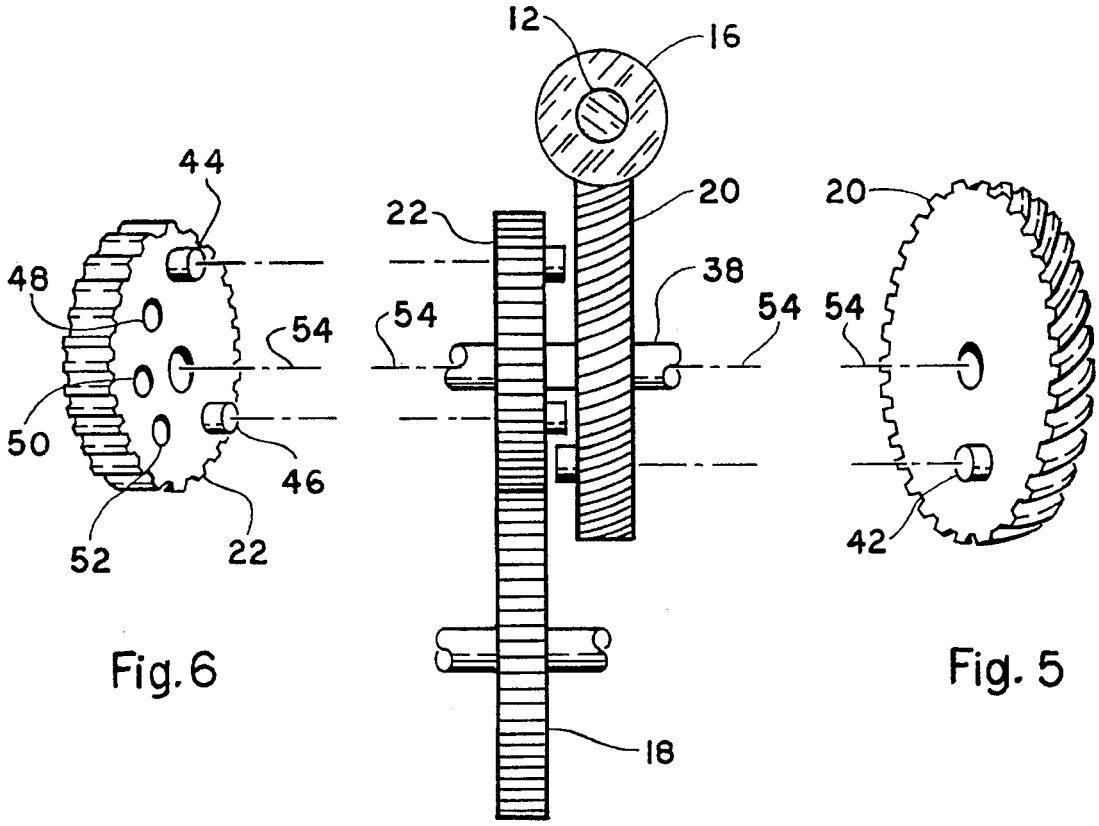
FIG. 4 is a front elevational view showing a preferred embodiment of the drive system of the present invention.
FIG. 5 is a perspective view showing the first intermediate gear in the embodiment of FIG. 4; and, FIG. 6 is a perspective view showing the second intermediate gear in the preferred embodiment of FIG. 4.

FIG. 4 shows a preferred embodiment of the present invention. In it, the shaft 12 turns the worm gear 16 which drives the first intermediate gear 20.

Figure 1:
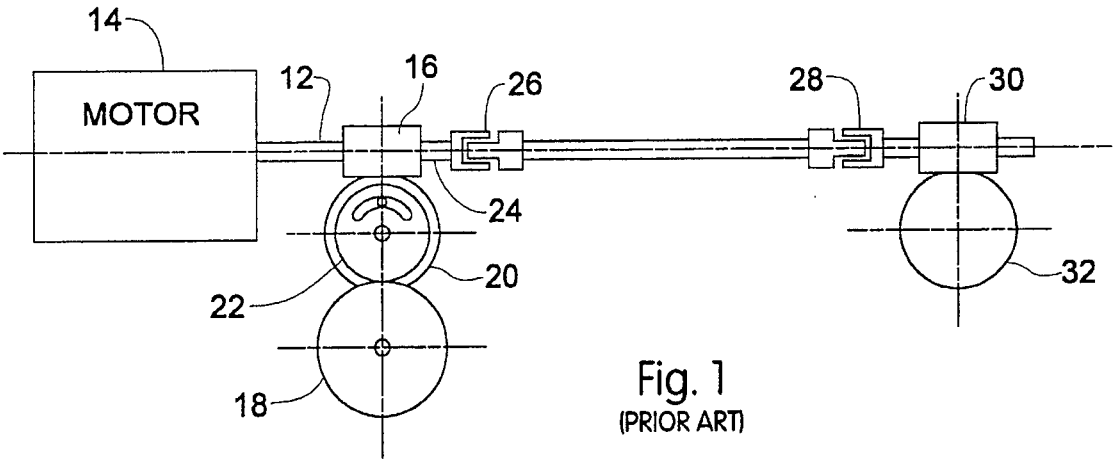
Fig. 1 (PRIOR ART)
FIG. 1 is a diagram showing the principal components used in a drive system in the prior art.
Figure 2:
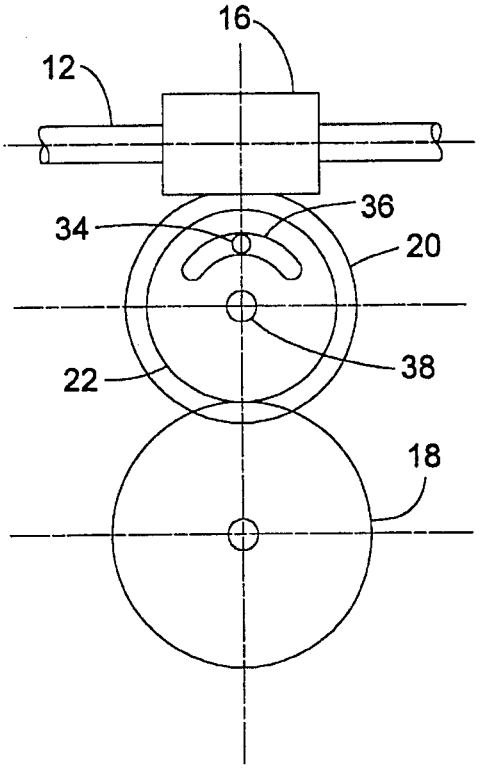
Fig. 2 (PRIOR ART)
FIG. 2 is a diagram showing a portion of the diagram of FIG. 1 in greater detail.
Figure 3:
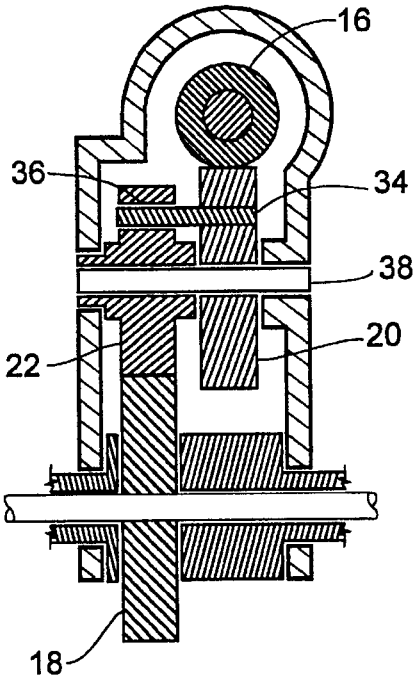
Fig. 3 (PRIOR ART)
FIG. 3 is a diagram showing a front view of the drive system of FIG. 2.

As best seen in FIG. 5, the first intermediate gear 20 is provided with a pin 42 that extends perpendicular to the face of the gear 20 and extends towards the second intermediate gear 22. The pin 42 is shorter than the pin 34 of the embodiment of FIG. 3, and the pin 42 extends from the face of the gear 20 a distance that is less than the separation between the first intermediate gear 20 and the second intermediate gear 22.

As best seen in FIG. 6, the second intermediate gear 22 is provided with two pins 44 and 46 which extend from the face of the gear 22 toward the first intermediate gear 20 a distance which is shorter than the separation between the first intermediate gear 20 and the second intermediate gear 22. The second intermediate gear 22 is also provided with several holes 48, 50 and 52 into which either of the pins 44 or 46 could be inserted.

The centers of the pins 42, 44 and 46 and the centers of the holes 48, 50 and 52 are all located at the same radius from the common axis 54.

In operation, as the first intermediate gear 20 is driven by the worm gear 16, it rotates about the axis 54, but because the gears 20 and 22 are not coupled to the shaft 38, they freely rotate independently on the shaft 38. During this initial phase of the rotation of the first intermediate gear 20, the second intermediate gear 22 remains stationary until the pin 42 makes contact with either the pin 44 or the pin 46 depending upon the direction of rotation of the gear 20. After contact has been established, the gears 20 and 22 rotate in unison on the shaft 38.

Assuming, for purposes of illustration that contact was with the pin 44, when the motor 14 is turned off, the worm gear 16 prevents further rotation of the intermediate gear 20, but the momentum of the train keeps the intermediate gear 22 rotating in the same direction until the pin 42 makes contact with pin 46. Upon resuming the initial direction, the pin 42 must travel through the angle between pin 46 and pin 44 before the intermediate gear 22 will start to turn, thereby providing the desired lost motion. If the train does not have enough momentum to continue to rotate intermediate gear 22 after worm gear 16 has stopped, then the desired lost motion will take place upon the change in the rotational direction of worm gear 16 when the locomotive begins to operate in the opposite direction.

The duration of the lost motion can readily be altered by pulling one of the pins 44 or 46 from the gear 22 and inserting it into a different hole, such as the holes 48, 50 and 52.

It will be apparent to persons skilled in the art that the desired lost motion effect can be achieved in an alternative embodiment in which the pins 44 and 46 and the holes 48, 50 and 52 are included in the first intermediate gear 20 and in which the pin 42 is included in the second intermediate gear 22.

Thus, there has been described a lost motion mechanism which, unlike a prior art mechanism, does not require the milling of elongated curved slots, which therefore results in a stronger gear, and in which the amount of lost motion is selectable and can readily be altered.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. Apparatus for imparting a delayed rotary motion to a gear, comprising:

a first gear having a first face, said first gear rotatable about an axis through its center;

a second gear having a first face that faces the first face of said first gear, said second gear rotatable about said axis;

means for mounting said first gear and said second gear for rotation about said axis;

a first pin that protrudes parallel to said axis from the first face of said first gear;

a second pin and a third pin that both protrude parallel to said axis from the first face of said second gear;

said first pin, said second pin, and said third pin all located at the same radius from said axis;

the protrusion of said first pin plus the protrusion of said second pin exceeding the separation between said first gear and said second gear;

the protrusion of said first pin plus the protrusion of said third pin exceeding the separation between said first gear and said second gear.

* * * * *